United States Patent [19]

Real et al.

[11] 3,998,154

[45] Dec. 21, 1976

[54] HAMMER ASSEMBLY FOR USE IN IMPACT PRINTERS

[75] Inventors: Kenneth G. Real, Redmond; Larry P. Ellefson, Seattle; Robert J. Brooks, Bellevue, all of Wash.

[73] Assignee: Interface Mechanisms, Inc., Mountlake Terrace, Wash.

[22] Filed: Nov. 13, 1975

[21] Appl. No.: 631,742

[52] U.S. Cl. ..... 101/93.48

[51] Int. Cl.[2] ..... B41J 9/02

[58] Field of Search ..... 101/93.18, 93.19, 93.48, 101/93.28–93.34, 93.03, 99, 110, 111

[56] References Cited

UNITED STATES PATENTS

| | | | |
|---|---|---|---|
| 3,301,177 | 1/1967 | Shepard | 101/93.33 |
| 3,447,455 | 6/1969 | Shneider | 101/93.48 |
| 3,874,287 | 4/1975 | Aldea | 101/93.48 |
| 3,905,294 | 9/1975 | Barrus et al. | 101/93.48 |
| 3,923,199 | 12/1975 | Real | 221/73 |

FOREIGN PATENTS OR APPLICATIONS

| | | | |
|---|---|---|---|
| 1,379,645 | 1/1975 | United Kingdom | 101/93.48 |

*Primary Examiner*—Edward M. Coven
*Attorney, Agent, or Firm*—Christensen, O'Connor, Garrison & Havelka

[57] ABSTRACT

An improved hammer assembly is disclosed for use in impact printers having a print station comprising a continuously rotating print wheel and an adjacent hammer mechanism for selectively impacting print stock and an interposed ink ribbon against a raised element on the print wheel to thereby imprint a character on the print stock. The hammer assembly includes an elongated hammer having a hammer surface at one end and an actuating surface at the other end which is engaged by a hammer actuating device in the hammer mechanism having a controllable, substantially reciprocative movement. The elongated hammer is supported for substantially reciprocative, planar movement with respect to a similarly elongated first support member by a pair of linear leaf springs which extend between the elongated hammer and the first support member in a spaced-apart, parallel manner. A second support member is provided for rigidly securing the hammer assembly to a support means in the hammer mechanism and is connected to the first support member by a flexure which is located on the first support member at a location offset from but adjacent to a first end thereof. A pin is located on the first support member at a location offset from but adjacent to a second end thereof and extends at right angles from the first support member and through an aperture in the support means. A cam is rotatable on the pin and engages the aperture in the support means to permit adjustable rotation of the first support member, and accordingly the elongated hammer, with respect to the fixed second support member to insure that the hammer surface is vertically aligned with respect to the print wheel.

10 Claims, 3 Drawing Figures

Fig. 1.
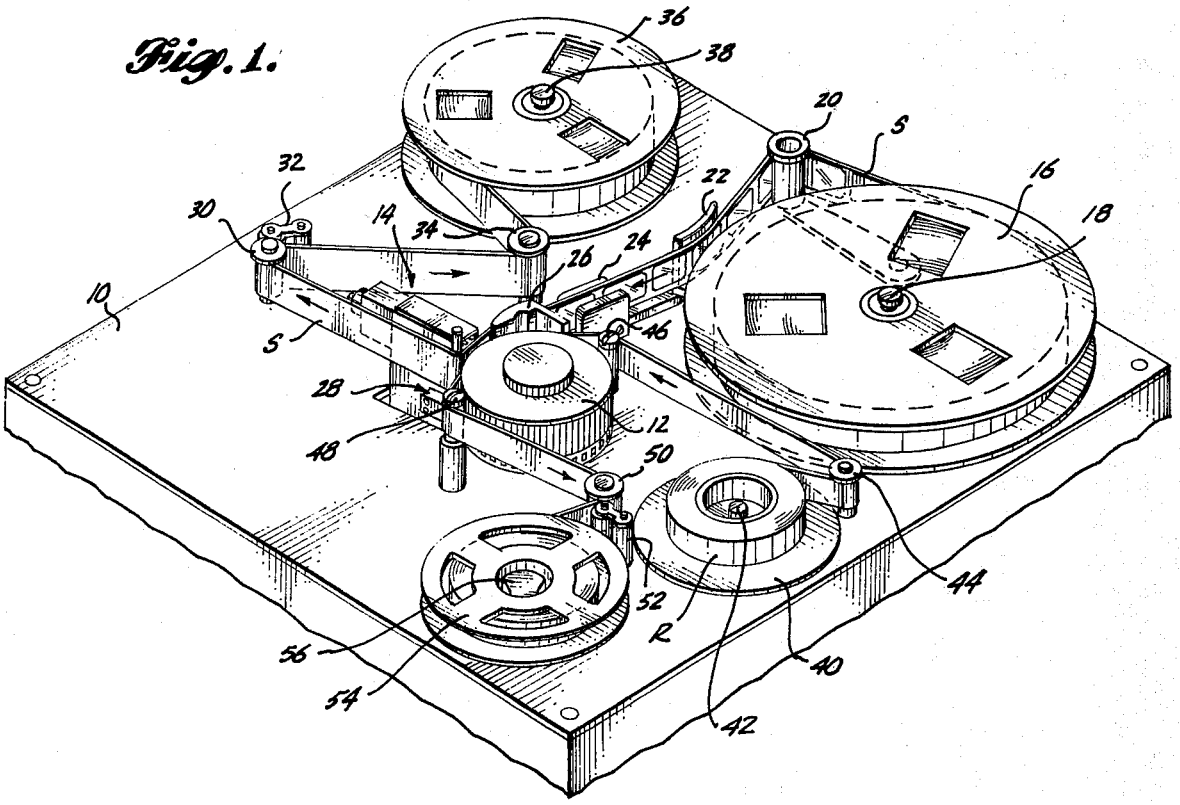
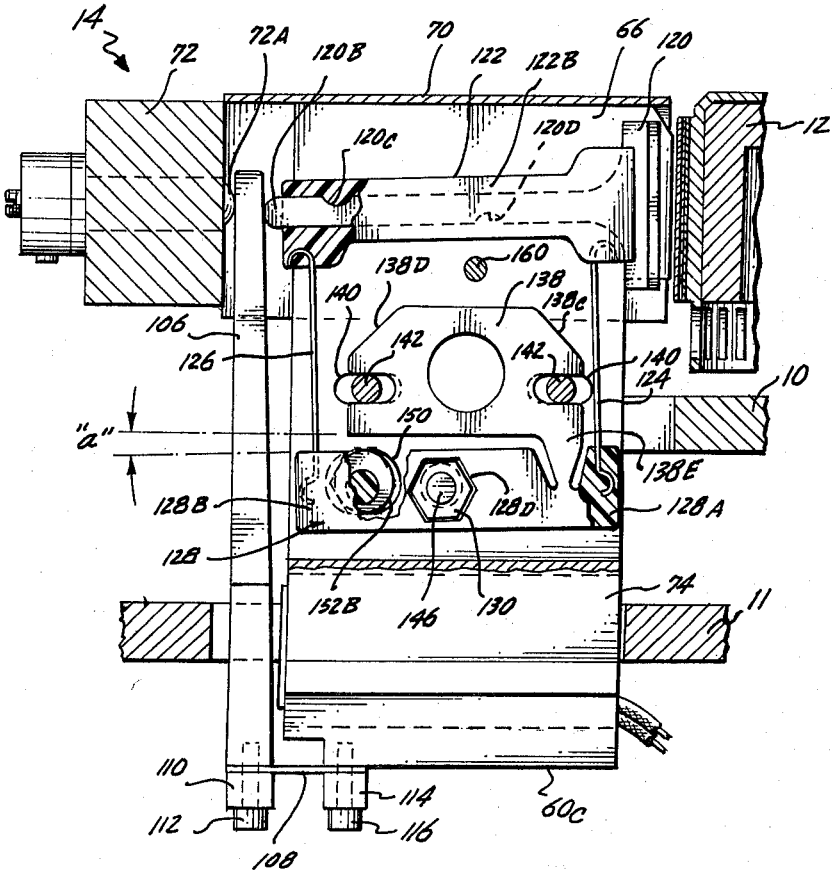
Fig. 2.

HAMMER ASSEMBLY FOR USE IN IMPACT PRINTERS

FIELD OF THE INVENTION

This invention generally relates to impact printers for imprinting characters on an elongated strip of print stock, and more particularly, to an improved hammer assembly used in the hammer mechanism of such impact printers.

BACKGROUND OF THE INVENTION

Mechanical impact printers are known to the prior art including a print station comprising a continuously rotating print wheel having a plurality of successive raised elements located on a circumferential surface thereof and an adjacent hammer mechanism which is selectively controllable to impact, by means of a hammer surface, an interposed elongated strip of print stock and an ink ribbon against one of the raised elements on the circumferential surface of the print wheel, thereby imprinting a character on the print stock. The hammer mechanisms of the prior art have included a hammer assembly comprising an elongated hammer having the hammer surface at one end thereof and an actuating surface at another end thereof which is engaged by a hammer actuating means which is capable of substantially reciprocative, planar movement. The elongated hammer itself is supported for planar, reciprocative movement above a similarly elongated support member by a pair of linear leaf springs extending between the support member and the elongated hammer in a spaced-apart, parallel manner.

In order to insure that the hammer surface is vertically aligned with the raised elements on the circumferential surface of the print wheel when the hammer surface impacts thereon, the prior art has taught means coupled to the support member of the hammer assembly for adjusting the orientation of the support member, and therefore the hammer, with respect to a fixed support.

The prior art apparatus has been disadvantageous, however, in requiring a complicated mechanism sufficient to allow both horizontal and vertical adjustment of the support member, and therefore the elongated hammer, as well as allowing adjustment of the vertical inclination of the hammer surface. In addition, the prior art apparatus has been difficult to utilize in that adjustments in vertical position of the hammer assembly adversely affect pre-set adjustments in the horizontal position thereof, with a resultant increase in the amount of time needed by a technician to properly setup and align the hammer assembly. Further, the prior art apparatus has required many expensive and complicated machined parts for its implementation.

It is therefore an object of this invention to provide an improved hammer assembly which overcomes the disadvantages of the prior art.

It is a further object of this invention to provide an improved hammer assembly for impact printers which, when installed in a hammer mechanism of an impact printer, permits easy and fast adjustment of horizontal and vertical location of the hammer assembly in a predetermined plane of hammer movement while yet allowing similarly easy and fast adjustment of the vertical inclination of the hammer surface.

It is another object of this invention to provide such an improved hammer assembly which is simple of construction and inexpensive of manufacture.

It is still another object of this invention to provide an improved adjusting mechanism for utilization for such an improved hammer assembly which requires a minimum of moving parts.

SUMMARY OF THE INVENTION

These objects and others, which will be realized from a consideration of the following portion of the specification, are realized in one embodiment of the invention by the provision of a first support member to which is secured a pair of linear leaf springs which in turn support an elongated hammer for substantially reciprocative, planar movement with respect to the first support member. The first support member is elongated and has first and second ends. A second support member is provided which is rigidly secured to a hammer assembly support means within the hammer mechanism. Flexure means are provided for connecting the second support member to the first support member at a location on the first support member offset from but adjacent to the first end. Further, adjusting means are located on the first support member for allowing rotation of the first support member, and accordingly the elongated hammer, with respect to the second support member through the flexure means. In a preferred embodiment, the adjusting means may comprise a pin located on the first support member at a location offset from but adjacent to the second end thereof which extends at right angles from the first support member and through an aperture in the hammer assembly support means. A cam is rotatable on the pin and engages the aperture in the hammer assembly support means to permit adjustable rotation of the first support member with respect to the second support member.

BRIEF DESCRIPTION OF THE DRAWINGS

The invention can perhaps best be understood by reference to the following portion of the specification taken in conjunction with the accompanying drawings in which:

FIG. 1 is a pictorial view of an impact printer including a print station comprising a hammer mechanism having the hammer assembly of the present invention;

FIG. 2 is a cross-sectional view of the print station including a continuously rotating print wheel and the hammer mechanism.

DESCRIPTION OF A PREFERRED EMBODIMENT

Figure 3:
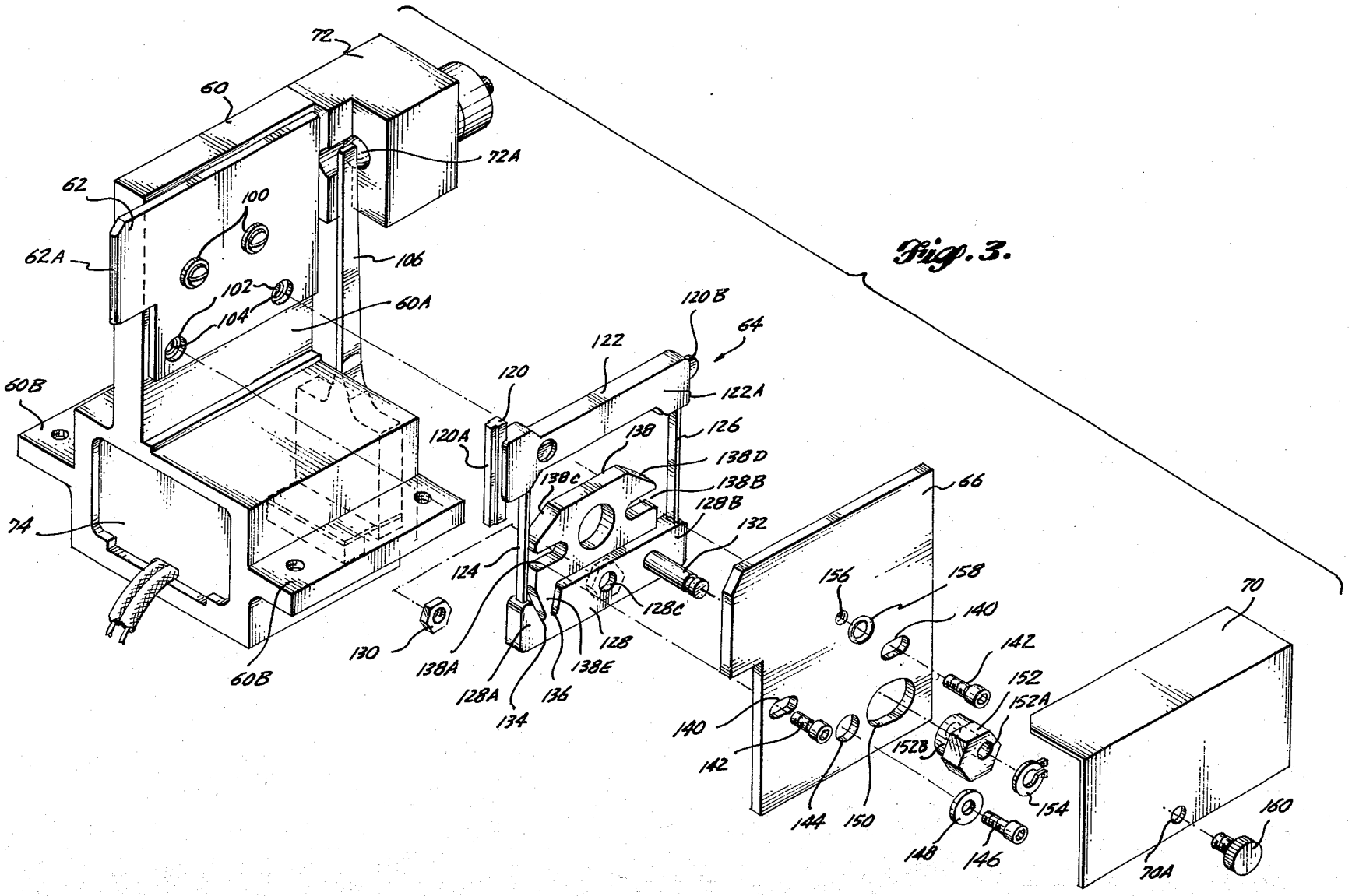
FIG. 3 is an exploded, pictorial view showing the hammer mechanism.

Referring now to FIG. 1, an impact printer includes a base plate 10 above which a print wheel 12 is supported for rotation. The circumferential surface of print wheel 12 has located thereon a plurality of raised elements representing the characters to be imprinted and is continuously rotated by a drive means, not illustrated. A hammer mechanism 14 is located in proximity to the print wheel 12 and together with the print wheel 12 forms a print station. As will be explained in more detail hereinafter, the hammer mechanism 14 includes a hammer which is capable of a controllable, reciprocative movement whereby a hammer face thereof impacts a print stock, and, more particularly, a back surface of a label stock backing S to press one of a plurality of labels removably adhering to a front surface thereof and an interposed ink ribbon R against one of the raised elements on print wheel 12 to thereby imprint a character on the label.

The print stock including the label stock backing S is obtained from a print stock supply reel 16 which rotatably supported on a shaft 18 mounted on base plate 10. From the print stock supply reel 16, the print stock is first drawn around a supply tension roller 20 also supported on base plate 10 and from there past a guide member 22, a print stock sensor 24 and a guide member 26 to the print station. Immediately after leaving the print station, the print stock is caused to change its direction by approximately 90° by a drive capstan 30 which presses the print stock against a label stripping apparatus 28. The drive capstan 30 is rotated by a drive capstan motor, not illustrated, mounted below the base plate 10. The print stock is maintained in engagement with the drive capstan 30 by a pinch roller 32 mounted on the base plate 10.

From the drive capstan 30, the print stock passes around a take-up tension roller 34 mounted on base plate 10 and then on to a take-up reel 36 which is rotatable on a shaft 38 of a take-up drive motor, not illustrated.

The ink ribbon R is similarly obtained from a ribbon supply reel 40 which is rotatable on a shaft 42 mounted on base plate 10. From the ribbon supply reel 40, the ink ribbon R passes around a supply roller 44, a guide pin 46, through the print station and to a guide pin 48, with supply roller 44, guide pin 46 and guide pin 48 all being mounted on base plate 10. From guide pin 48, the ink ribbon passes around a drive capstan 50 which is rotated by a drive capstan motor, not illustrated, and is pressed against drive capstan 50 by a pinch roller 52 mounted on base plate 10. From drive capstan 50, the ink ribbon R is taken up on a ribbon take-up reel 54 which is rotatable with a shaft 56 of a ribbon driver motor, not illustrated.

As is conventional in the prior art, electronic control means is provided for controlling the rotation of drive capstans 30, 50 to provide movement of the label stock backing S and the ink ribbon R past the print station. Electronic control means is likewise provided for coordinating the movement of the hammer within the hammer mechanism 14 with the rotation of the print wheel 12 under control of timing signals obtained from print wheel 12 to provide imprinting of selected characters in succession on the labels removably adhering to the label stock backing S.

Referring now to FIGS. 2–3, the hammer mechanism 14 is seen to comprise a support member 60 which has a substantially planar support surface 60A. The base plate 10 includes an aperture through which the majority of support member 60 protrudes in assembly. The support member 60 is secured to the under side of a support plate 11 by fasteners passing through corresponding apertures in a pair of integral support lugs 60B. In turn, the support plate 17 is secured to base plate 10, by means not illustrated. When so secured to base plate 10, support member 60, and more particularly, the planar support surface 60A, defines a plane which is parallel to a desired, predetermined plane of hammer movement. For purposes of reference the horizontal and vertical directions referred to hereinafter will comprise corresponding orthogonal directions in the plane established by surface 60A, or any plane parallel thereto.

Attached to support member 60 is a hammer actuating means which has a controllable, substantially reciprocative movement. The hammer actuating means includes an elongated actuating arm 106 whose broadened, lower portion is attached to a flat leaf spring 108 by a plurality of fasteners 112 passing through a substantially rectangular support block 110. The flat leaf spring 108 is in turn secured to a lower surface 60C of support member 60 by a plurality of fasteners passing through a substantially rectangular support block 114 and flat leaf spring 108. Those skilled in the art will readily recognize that the actuating arm 106 is thereby pivotedly attached to the support member 60. However, due to the stiffness and breadth of flat leaf spring 108, the upper end of actuating arm 106 is capable of substantially reciprocative movement over small increments of its travel. Lower surface 60C of support member 60 has a plane substantially normal to the plane of surface 60A. Therefore, the reciprocative movement of the upper end of actuating arm 106 is in a plane parallel to but offset from the plane of surface 60A.

The actuating arm 106 is normally maintained in the position illustrated in FIGS. 2 and 3 by the flat leaf spring 108, and is caused to have the reciprocative movement by electromagnetic forces provided by the energization of a solenoid 74 which is located within a cavity of support member 60. Energization of the solenoid 74 is provided by the application of electrical impulses thereto, one for each desired actuation of the hammer mechanism, which caused the actuating arm 106 to be quickly drawn forward and then released to return to its original position due in part to flat leaf spring 108. A damper assembly 72 is secured to the support member 60 and includes a damper 72A for engaging and cushioning the actuating arm 106 upon its return.

A first, substantially planar guide plate 62 is provided which abuts the surface 60A of support member 60 in assembly and which is secured to support member 60 by a pair of fasteners 100 which pass through corresponding apertures in guide plate 62 and are threaded into support member 60. Guide plate 62 has a front, substantially vertical surface 62A which allows for vertical orientation of the label stock backing S during imprinting. A pair of apertures 102 are also provided in guide plate 62 which overlie corresponding threaded apertures 104 in support member 60 and function to allow securing of a hammer assembly 64 and a second guide plate 66 to support member 60 as hereinafter described.

The hammer assembly 64 is substantially planar in construction and includes an elongated hammer 120 having a hammer surface 120A at one end thereof and an actuating surface 120B at the other end thereof. The elongated hammer 120 is supported for planar, substantially reciprocative movement by a pair of linear leaf springs 124, 126. First ends of the linear leaf springs 124, 126 are secured to locations adjacent the ends of the elongated hammer 120 by a spring securing member 122 which comprises a molded plastic member encasing the respective first ends of springs 124, 126 and the majority of elongated hammer 120. Notches 120C, 120D (FIG. 2) are provided in the elongated hammer 120. During the molding process, the molded plastic of spring securing member 122 enters the notches 120C and 120D to form lugs which, with notches 120C, 120D, prevent horizontal shifting of the elongated hammer 120 with respect to the spring securing member 122. The spring securing member 122 further defines substantially planar bearing surfaces 122A, 122B (FIG. 2) for permitting the assembly including elongated hammer 120 and spring securing member 122 to smoothly move between the first and second guide plates 62, 66.

Linear leaf springs 124, 126 extend in a generally vertical direction and second ends thereof are secured in respective ends 128A, 128B of a first support member 128 which may also comprise a molded plastic member. An adjusting means comprising a pin 132 is located adjacent end 128B and extends at right angles with respect to the horizontal and vertical directions thereof. In the preferred embodiment, the pin 132 is also of molded plastic and is integral with the first support member 128. A flexure means is located adjacent the end 128A of first support member 128 and is seen to be formed by a flexure portion 138E of a second, substantially planar support member 138 which, in a preferred embodiment, is a molded plastic member integral with the first member 128. In such an embodiment, the flexure portion 138E is formed by a pair of oppositely-inclined notches 134, 136 in first support member 128 which result in a reduced cross-sectional area of flexure portion 138E at the location adjacent to first support member 128 and an increasing cross-sectional area in a vertical direction toward second support member 138. The second support member 138 is seen to define first and second, substantially horizontal notches 138A, 138B and first and second cut away surfaces 138C, 138D.

It will be appreciated by those skilled in the art that if the second support member 138 is rigidly secured to support member 60, the vertical inclination of first support member 128, and therefore the assembly including elongated hammer 120 and spring securing member 122 can be adjusted by rotation thereof about the flexure means provided by flexure portion 138 E.

The second guide plate 66 is also substantially planar and includes elongated apertures 140 extending therethrough which overlie notches 138A, 138B in the second support member 138 of the hammer assembly 64, a circular aperture 144 overlying a corresponding aperture 128C centrally located in the first support member 128, and an elongated aperture 150 overlying the adjusting means including pin 132.

In assembly, the hammer assembly 64 is first secured to the second guide plate 66 by a threaded fastener 146 passing through a washer 148, aperture 144 in second guide plate 66, aperture 128C in first guide member 64, and threaded into a nut 130 which is received within a nut recess 128D situated in first support member 128 and overlying the aperture 128C therein. The combination of the hammer assembly and second guide plate 66 is then secured to the support member 60 by a pair of fasteners 142 passing through elongated apertures 140 in second guide plate 66, notches 138A, 138B in the second guide member 138 of hammer assembly 64, apertures 102 in first guide plate 66, and threaded into the threaded apertures 104 in support member 60. When assembled in this manner, the fasteners 142 effectively secure the second support member 138 to the support member 60 and therefore establish the vertical position of the hammer assembly by engagement with the notches 138A, 138B of second support member 138. In addition, the horizontal position of the hammer assembly is also fixed thereby, with adjustment of that horizontal position being possible by an amount equal to the horizontal depth of notches 138A, 138B.

The aperture 144 in second guide plate 66 is oversized with respect to the diameter of fastener 146. Accordingly, when fastener 146 is not tightened, it may move in all directions within the constraints of aperture 144, thereby permitting rotation of the first support member 128 with respect to the second support member 138 through the flexure means including the flexure portion 138E as previously described. This movement is controlled by means co-acting with the adjusting means including pin 132 as will now be described. A cam member 152 is provided which includes a substantially cylindrical cam surface 152B whose diameter is slightly smaller than the vertical dimension of elongated slot 150 in second guide plate 66, and an aperture 152A extending therethrough for receiving the guide pin 132. In assembly, the cam member 152 is placed on guide pin 132 so that the cam surface 152B engages the surface of the elongated aperture 150. Cam member 152 is retained on guide pin 132 by a split ring 154 snapped into a corresponding groove on the end of guide pin 132.

With particular reference to FIG. 2, it will be seen that the location of aperture 152A is eccentric with respect to cam surface 152B. Therefore, rotation of cam member 152 around guide pin 132 causes rotation of the first guide member 128 with respect to the second guide member 138 through the flexure means including flexure portion 138E by an angle *a*, due to engagement of cam surface 152B with the elongated aperture 150.

The variation in angle of inclination *a* of the first support member results in a corresponding change in the angle of vertical inclination of the elongated hammer 120, and therefore the hammer surface 120A.

Preferably, the second support member 138 has a slightly greater dimension in a direction normal to the predetermined plane of hammer movement, or, parallel to pin 132, than does the first support member 128. To properly align the hammer surface 120A, it is therefore only necessary to first adjust the horizontal position of the hammer assembly 64 by moving the hammer assembly 64 relative to the fasteners 142. Once the horizontal position is ascertained, the fasteners 142 are tightened to secure the second guide plate 66, and the second support member 138, securely against the first guide plate 62. The vertical inclination of the hammer surface 120A is then adjusted by rotation of cam member 152. When the vertical inclination has been ascertained, the first support member 128 is secured to the second guide plate 66 by tightening fastener 146.

The spring support member 122 is also chosen to have a slightly smaller dimension in the direction of pin 132 than that of second support member 138. Accordingly, the elongated hammer 120 and spring support member 122 are free to move in the predetermined plane of movement when alignment is completed. It will be appreciated that this predetermined plane of movement is aligned with the predetermined plane of movement of the actuating arm 106 when the assembly is completed, and that reciprocative movement of the actuating arm 106 causes a corresponding reciprocative movement of the elongated hammer 120 by engagement of the upper end of actuating arm 106 with the actuating surface 120B of elongated hammer 120.

The hammer mechanism is completed by a cover 70, a first portion of which overlies the top of the hammer mechanism including support member 60, first guide plate 62, hammer assembly 64 and second guide plate 66, and a second portion of which overlies the second guide plate 66 and is secured thereto by a threaded fastener 160 passing through an aperture 70A in cover 70, a spacer 158, and threaded into a corresponding aperture 166 in guide plate 66.

While the invention has been described with reference to preferred embodiment thereof, it is to be clearly understood to those skilled in the art that the invention is not limited thereto, but rather is to be bounded only by the limits of the appended claims.

We claim:

1. A hammer assembly for use in an impact printer including a print station comprising hammer assembly support means and hammer actuating means having a controllable, substantially reciprocative movement, said hammer assembly comprising:

a. an elongated hammer means having a hammer surface located at one end thereof and an actuating surface located at the other end thereof suitable for engaging the hammer actuating means, b. an elongated first support member having first and second ends, c. first and second linear leaf springs having their ends rigidly secured to said elongated hammer means and to said first support member at corresponding ends thereof and supporting said elongated hammer for substantially reciprocative, planar movement with respect to said first support member, d. a second support member capable of being rigidly secured to the hammer assembly support means, e. flexure means connecting said second support member to said first support member at a location thereon offset from but adjacent to said first end, and f. adjusting means coupled to said first support member for permitting adjustable rotation of said first support member, and accordingly said elongated hammer means, with respect to said second support member through said flexure means.

2. A hammer assembly as recited in claim 1, wherein said elongated hammer means comprises an elongated beam having said hammer surface and said actuating surface at respective ends thereof and further comprises a spring securing member encasing said elongated beam intermediate said hammer surface and said actuating surface and additionally encasing respective ends of said first and said second linear leaf springs.

3. A hammer assembly as recited in claim 2, wherein said spring securing member is a molded plastic member.

4. A hammer assembly as recited in claim 3, wherein said elongated beam includes at least one notch intermediate said hammer surface and said actuating surface, and wherein said molded plastic member includes at least one lug received in said at least one notch, for inhibiting movement of said elongated beam with respect to said molded plastic member encasing said elongated beam.

5. A hammer assembly as recited in claim 1, wherein said flexure means comprises a molded plastic member having a first portion with a first cross-sectional area adjacent to one of said first and said second support members and a second portion having a second cross-sectional area less than said first cross-sectional area which is adjacent to the other of said first and said second support members.

6. A hammer assembly as recited in claim 5, wherein said first and said second support members also comprise molded plastic members integral with the molded plastic member of said flexure means.

7. A hammer assembly as recited in claim 6, wherein said adjusting means comprises a molded plastic pin integral with said first support member which is located thereon adjacent said second end and which extends at right angles with respect to the elongated direction thereof, means defining an aperture in the hammer assembly support means through which said pin extends when said hammer assembly is installed by securing said second support member to the hammer assembly support means, and a cam member rotatable on said pin and including an eccentric cam surface positioned in said aperture when installed for engaging said hammer assembly support means.

8. An improved imprinting mechanism for use with an impact printer, said imprinting mechanism comprising:

a. a hammer assembly support means and a hammer actuating means having a controllable, substantially reciprocative movement in a direction contained in a first plane, b. a hammer assembly including a hammer means which is elongated in a first direction and which has located at one end thereof, a hammer surface and at the other end thereof an actuating surface engagable with said hammer actuating means, said hammer assembly further including a first support member also elongated in said first direction, and having first and second ends, first and second linear leaf springs having their ends rigidly secured to said hammer means and to said first support member at corresponding ends thereof and supporting said hammer for substantially reciprocative, planar movement with respect to said first support member, a second support member, flexure means connecting said second support member to said first support member at a location offset from but adjacent to said first end, so that said first and said second support members and said hammer means, define a second plane comprising said first direction and a direction perpendicular thereto, and a first adjusting means connected to said first support member and extending at right angles to said second plane, c. means securing said second support member to said hammer assembly support means so that said second plane substantially coincides with said first plane, and d. second adjusting means secured to said hammer assembly support means and coacting with said first adjusting means for permitting adjustable rotation of said first support member, and accordingly said hammer means, in said second plane with respect to said second support member.

9. An improved imprinting mechanism as recited in claim 8, wherein said first adjusting means comprises a pin extending from said first support member at a location thereon adjacent said second end, and wherein said second adjusting means comprises means defining an aperture in said hammer assembly support means through which said pin extends, and a cam member rotatable on said pin and including an eccentric cam surface positioned in said aperture and engaging said hammer assembly support means.

10. An improved imprinting mechanism as recited in claim 8, wherein said second support member defines therein at least one substantially horizontal, elongated aperture in said second plane, and wherein said securing means comprises a fastener passing through said elongated aperture in a direction normal to said second plane.

* * * * *